US005581912A

United States Patent [19]

Adams

[11] Patent Number: 5,581,912

[45] Date of Patent: Dec. 10, 1996

[54] FOOTWEAR SADDLE

[75] Inventor: Thomas M. Adams, San Antonio, Tex.

[73] Assignee: In Stride, Inc., Lincoln, Nebr.

[21] Appl. No.: 456,835

[22] Filed: Jun. 1, 1995

Related U.S. Application Data

[63] Continuation-in-part of Ser. No. 314,701, Sep. 29, 1994, abandoned.

[51] Int. Cl.[6] ..... A43B 7/14

[52] U.S. Cl. ..... 36/72 R; 36/96

[58] Field of Search ..... 36/96, 107, 133, 36/54, 71, 77 R, 77 M, 72 R, 140, 95

[56] References Cited

U.S. PATENT DOCUMENTS

| | | |
|---|---|---|
| 260,854 | 7/1882 | Earle . |
| 682,182 | 9/1901 | Ellings . |
| 1,309,958 | 7/1919 | Phillips . |
| 1,717,438 | 6/1929 | Dickson . |
| 1,742,763 | 1/1930 | Gerard . |
| 1,753,415 | 4/1930 | Hepburn . |
| 2,139,858 | 12/1938 | Schwartz et al. . |
| 2,242,353 | 5/1941 | Gillis . |
| 2,244,031 | 6/1941 | Teehan . |
| 3,197,833 | 8/1965 | Puthuff . |
| 3,241,153 | 3/1966 | Brewer . |
| 4,342,159 | 8/1982 | Edwards . |
| 4,928,405 | 5/1990 | Spademan . |

FOREIGN PATENT DOCUMENTS

| | | |
|---|---|---|
| 516664 | 12/1920 | France . |

*Primary Examiner*—Ted Kavanaugh

*Attorney, Agent, or Firm*—Akin, Gump, Strauss, Hauer & Feld, L.L.P.

[57] ABSTRACT

A footwear saddle and method for dissipating pressure between footwear and the wearer's foot. The saddle comprises a member having a bridge offset from a central axis of the member which overlays the instep of the wearer's foot. During usage, the pressure between the footwear and the foot is dissipated by the saddle, the bridge maintaining the gap between the instep of the foot and the saddle.

15 Claims, 2 Drawing Sheets

FOOTWEAR SADDLE

This application is a continuation-in-part of U.S. patent application Ser. No. 08/314,701, filed Sep. 29, 1994 entitled FOOTWEAR SADDLE now abandoned.

BACKGROUND OF THE INVENTION

The present invention relates to a saddle or shield for footwear. More particularly, the present invention provides a saddle or shield for dissipating the pressure between footwear and the wearer's foot.

A snugly tied shoe or other footwear frequently causes discomfort along the dorsal metatarsal area or instep of the wearer's foot where the laces overlap or where other footwear securement apparatus is positioned. This discomfort becomes particularly acute as the feet swell during the course of the day. This discomfort may ultimately result in numbness, tingling, pain and muscle cramping of the wearer's foot.

SUMMARY OF THE INVENTION

Accordingly, the present invention provides a footwear shield or saddle which may be positioned along the dorsal metatarsal area or instep of the wearer's foot to dissipate or disperse the pressure between the footwear and the foot. This pressure may be caused by laces, buckles, or other footwear components which overlie the wearer's instep. The present invention also provides a method for dissipating or dispersing such pressure.

The footwear saddle of the present invention comprises a rigid but resilient member having a bridge which is offset from a central axis of the member toward the medial side of the foot. In one embodiment, an upward curve at the forward end of the member allows bending or flexion of the foot and a rearward end of the member has an arcuate or curved edge. In an alternate embodiment, the member has a groove or cut-out in the foward end and the forward, rearward and medial edges are canted upwards. During usage, the pressure between the footwear and the foot is dissipated by the saddle, the bridge overlying the dorsal metatarsal area or instep and maintaining a gap between the instep of the foot and the saddle.

DETAILED DESCRIPTION OF THE PREFERRED EMBODIMENT

Figure 1:
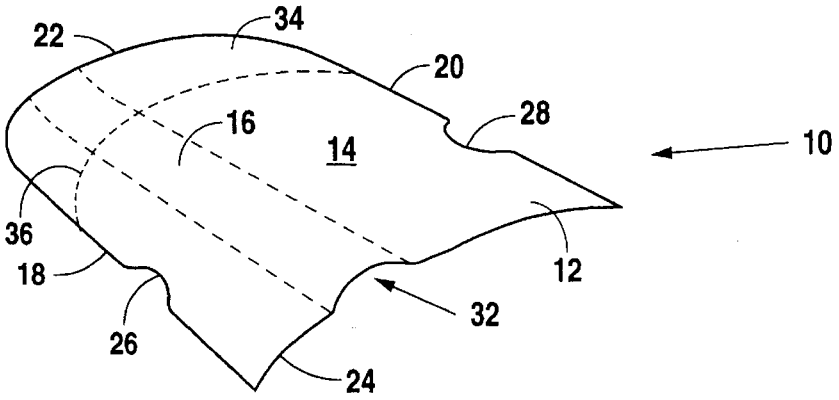
FIG. 1 is a perspective view of one embodiment of the footwear saddle of the present invention.
Figure 2:
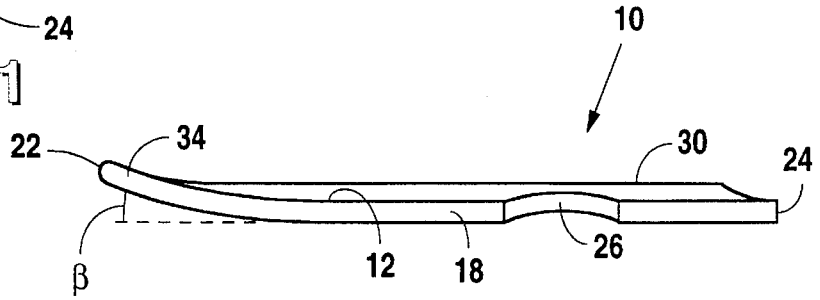
FIG. 2 is a side view of the footwear saddle of FIG. 1.

Referring to FIG. 1 and FIG. 2, one embodiment of the footwear or instep saddle of the present invention is identified by the number 10. The saddle 10 comprises a generally arcuate member 12 having a base 14 and a single bridge 16. Member 12 has a left edge 18, a right edge 20, a curved or arcuate forward edge 22 and a curved or arcuate rearward edge 24. Grooves or cut-outs 26 (left) and 28 (right) are formed in member 12 for purposes of stress relief. Bridge 16 has a top or apex 30 and defines a single channel or groove 32 along the length of member 12 in the underside of member 12. A forward end 34 is curved or bent upwards along bend line 36 at an angle $\beta$ in the range of approximately one to two degrees (1°–2°).

Figure 3:
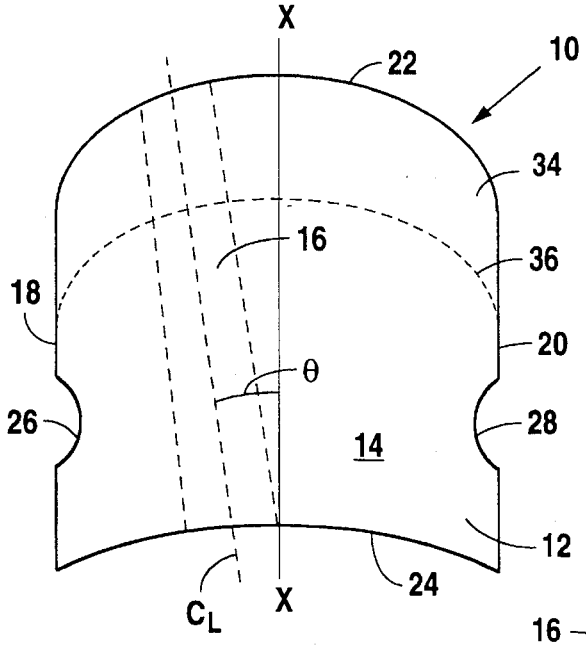
FIG. 3 is a top view of the footwear saddle of FIG. 1.

Referring to FIG. 3, bridge 16 extends from distal or forward edge 22 of member 12 to proximal or rearward edge 24. Further, the center line $C_L$ of bridge 16 is angled or offset from central axis X—X of member 12 at an angle $\theta$. The angle $\theta$ may be referred to as the metatarsus adductus angle and is preferably in the range of approximately ten to fifteen degrees (10°–15°), and preferably 12°.

The saddle 10 is preferably shaped so as to be attached to the footwear and form the tongue of the footwear, or be buried in a pocket of, or attached to, the footwear tongue. Alternatively, the saddle 10 may be separate from the footwear but positioned during usage between the footwear and the wearer's foot. Regardless of the manner of usage, however, saddle 10 contacts or otherwise engages or rides with the wearer's foot.

During usage, the saddle 10 is preferably positioned between the wearer's metatarsal phalangeal joints and the anterior tibial tendon with the bridge 16 positioned along and over the dorsal metatarsal area or instep of the wearer's foot toward the medial side of the foot. The curve of edge 22 and upward bend in forward end 34 prevents the bending or flexion of the wearer's foot from unduly pressing against the saddle 10 and allows unimpeded dorsiflexion of the metatarsal phalangeal joints. Likewise, the curve in edge 24 prevents the saddle 10 from digging into the wearer's anterior tibial tendon at the level of the ankle joint.

Figure 4:
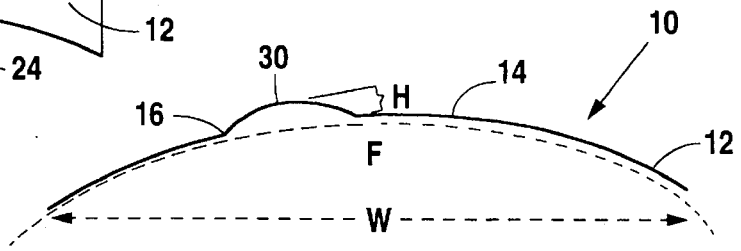
FIG. 4 is an end view of one embodiment of the footwear saddle of the present invention in a RELAXED configuration.
Figure 4A:
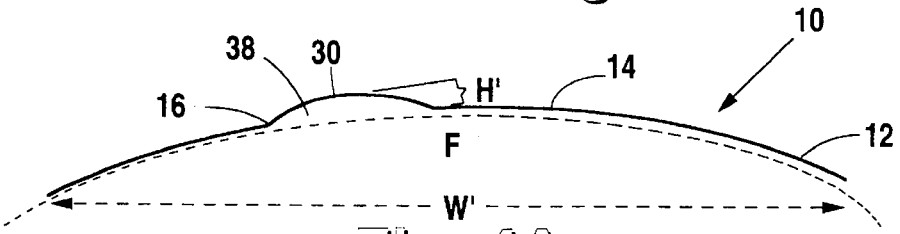
FIG. 4A is an end view of one embodiment of the footwear saddle of the present invention in a COMPRESSED configuration.

Prior to the wearer tightening the footwear, the saddle 10 is in the RELAXED configuration atop the wearer's foot F, as illustrated in FIG. 4, with bridge 16 having a height H from base 14 to apex 30 and member 12 having a width W. However, as the footwear laces are tied or as the footwear otherwise becomes tighter, the height H of bridge 16 decreases to H' and the width W of member 12 increases to W', as illustrated in FIG. 4A, thereby dissipating the pressure between the footwear and the wearer's foot F. However, in the COMPRESSED configuration, illustrated in FIG. 4A, bridge 16 maintains a space or gap 38 between the wearer's foot F and the saddle 10. When the footwear is loosened, the saddle 10 returns to the RELAXED configuration illustrated in FIG. 4

It is to be understood that the footwear saddle 10 illustrated in FIGS. 1–4 is for the right foot with the bridge 16 offset from and to the left of central axis X—X toward left edge 18 so as to overlie the instep of the wearer's right foot. However, in the configuration of the footwear saddle 10 for the wearer's left foot, bridge 16 is offset from and to the right of central axis X—X toward right edge 20 at the same angle $\theta$ as described hereinabove. The footwear saddle 10 for the left foot is otherwise identical to that described herein in connection with the right foot configuration. A wearer may use a saddle 10 in connection with either or both feet and may wear a sock between the saddle 10 and the foot.

In one embodiment, saddle 10 has a width W from edge 18 to edge 20 of approximately two and one-half inches (2.5") in the RELAXED configuration and a length along axis X—X of approximately two and six tenths inches (2.6"). In such embodiment, bridge 16 has a width of approximately one-half inch (0.5") in the RELAXED configuration. Further, in such embodiment, compression of member 12 to the COMPRESSED configuration increases the width of saddle 10 from edge 18 to edge 20 such that W' is approximately two and six tenths inches (2.6"). Further, member 12 may have a plurality of holes or perforations therein for weight reduction and for the cooling of the foot.

It is to be understood that saddle 10 of the present invention may be generally arcuate as described hereinabove or may be generally flat or planar prior to usage. However, in the generally flat configuration the saddle 10 forms a generally arcuate shape during usage between the wearer's foot and footwear. Likewise, forward end 34 may simply be bendable or capable of bending upwards along bend line 36 during usage. It is also to be understood that footwear saddle 10 of the present invention, in its generally arcuate configuration or generally flat configuration, may be provided without a bridge 16, although such an embodiment generally does not provide the full accommodative features discussed hereinabove.

The present invention also provides a method of dissipating or dispersing pressure between footwear and the instep of a wearer's foot comprising the steps of positioning a footwear saddle 10 on the top of the foot between the wearer's metatarsal phalangeal joints and anterior tibial tendon, the saddle 10 having a first or distal end 34 which is bendable upwards and a second or proximal end having an arcuate or curved proximal edge 24. The saddle 10 may be generally arcuate or generally flat and may be provided with a bridge 16. When the saddle 10 has a bridge 16, the positioning of the saddle 10 includes the step of positioning the bridge 16 along and over the dorsal metatarsal area or instep of the wearer's foot toward the medial side of the foot.

Referring to FIGS. 5–8, an alternate embodiment of the footwear or instep saddle of the present invention is identified by the number 40. The saddle 40 comprises a member 42 having a base 44 and a single arcuate bridge 46. Member 42 has a curved left edge 48, a curved right edge 50, a curved forward edge 52 and a curved rearward edge 54. Grooves or cut-outs 56 (left) and 58 (right) are formed in member 42 for purposes of stress relief. A forward groove or cut-out 59 is also formed in member 42 for the wearer's comfort. Bridge 46 has a top or apex 60 and defines a single channel or groove 62 along the length of member 42 in the underside of member 42.

Figure 5:
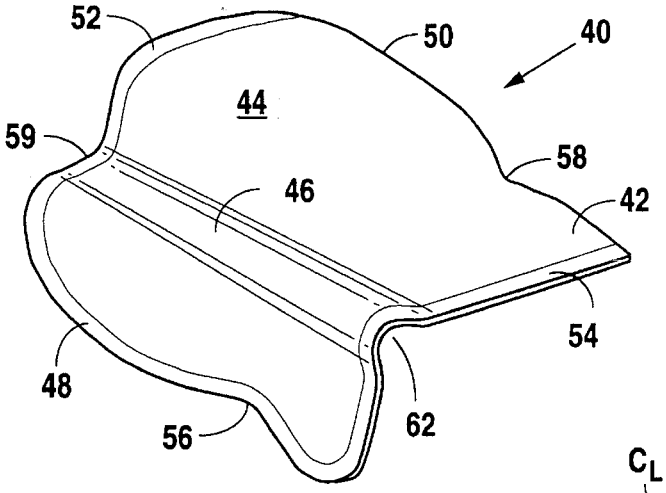
FIG. 5 is a perspective view of an alternate embodiment of the footwear saddle of the present invention.
Figure 7:
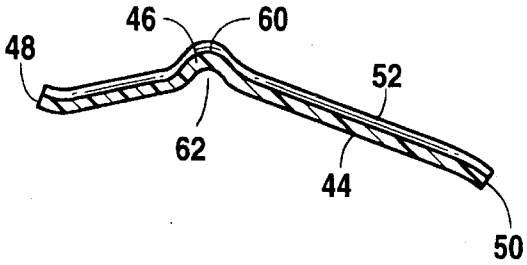
FIG. 7 is a cross-sectional view taken along section lines 7—7 of FIG. 6.
Figure 8:
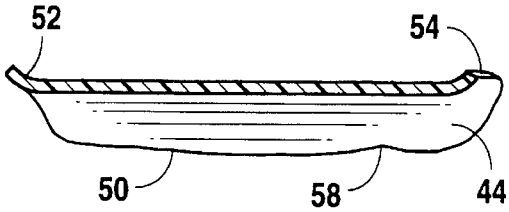
FIG. 8 is a cross-sectional view taken along section lines 8—8 of FIG. 6.

Referring to FIG. 5 and FIG. 7, member 42 has a generally inverted V shape with the medial side from bridge 46 shorter than the lateral side from bridge 46. The angle or downward bend in member 42 is such that member 42 generally conforms to or mates with the upper surface of the wearer's foot. Further, forward edge 52, left or medial edge 48 and rearward edge 54 are firmly canted or bent upward in a direction opposite to the downward bend of member 42 and away from the wearer's foot. Edge 50 is generally flat.

Figure 6:
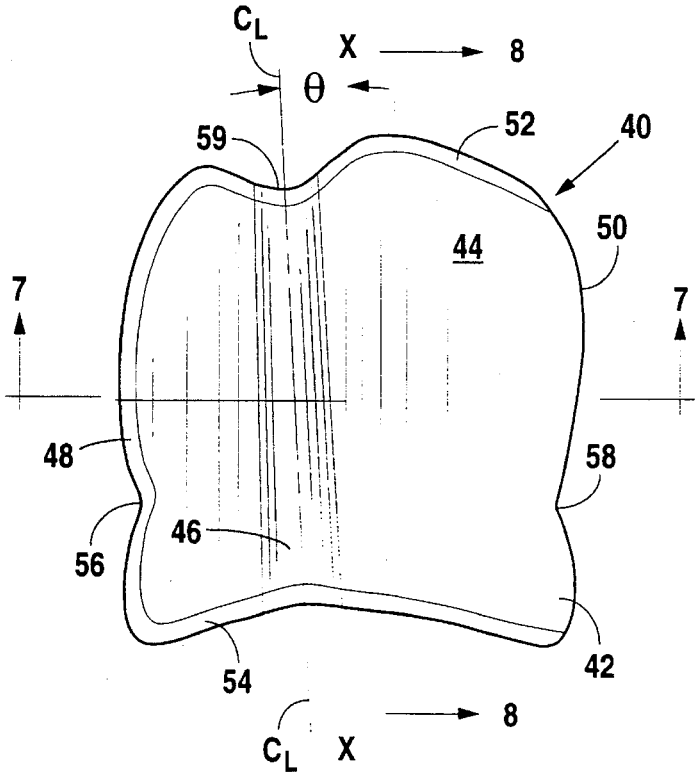
FIG. 6 is a top view of the footwear saddle of FIG. 5.

Referring to FIG. 6, bridge 46 extends from distal or forward edge 52 of member 42 to proximal or rearward edge 54. Further, the center line $C_L$ of bridge 46 is angled or offset from central axis of X—X of member 42 at an angle θ. The angle θ may be referred to as the metatarsus adductus angle and is preferably in the range of approximately ten to fifteen degrees (10°–15°), and preferably 12°.

The saddle 40 is preferably shaped so as to be attached to the footwear and form the tongue of the footwear, or be buried in the pocket of, or attached to, the footwear tongue. Alternatively, the saddle 40 may be separate from the footwear 18 but positioned during usage between the footwear and the wearer's foot. Regardless of the manner of usage, however, saddle 40 contacts or otherwise engages or rides with the wearer's foot.

During usage, the saddle 40 is preferably positioned between the wearer's metatarsal phalangeal joints and the anterior tibial tendon with the bridge 46 positioned along and over the dorsal metatarsal area or instep of the wearer's foot toward the medial side of the foot. The curve and upward bend of edge 52 and cut-out 59 prevent the bending or flexion of the wearer's foot from unduly pressing against the saddle 40 and allows unimpeded dorsiflexion of the metatarsal phalangeal joints. Likewise, the curve in edge 54 prevents the saddle 40 from digging into the wearer's anterior tibial tendon at the level of the ankle joint.

Prior to the wearer tightening the footwear, the saddle 40 is in the RELAXED configuration atop the wearer's foot in a manner similar to that described in connection with saddle 10. However, as the footwear laces are tied or the footwear otherwise becomes tighter, the height of bridge 46 decreases and the width of member 42 increases, as described in connection with saddle 10, thereby dissipating the pressure between the footwear and the wearer's foot. However, in the COMPRESSED configuration, bridge 46 maintains a space or gap between the wearer's foot and the saddle 40. When the footwear is loosened, the saddle 40 returns to the RELAXED configuration.

It is to be understood that the footwear saddle 40 illustrated in FIGS. 5–8 is for the right foot with the bridge 46 offset from and to the left of central axis X—X toward left edge 48 so as to overlie the instep of the wearer's right foot. However, in the configuration of the footwear saddle 40 for the wearer's left foot, bridge 46 is offset from and to the right of central axis X—X toward the right edge 50 at the same angle θ as described hereinabove. Cut-out 59 is likewise offset from and to the right of central of axis X—X. The footwear saddle 40 for the left foot is thus the mirror image to that described herein in connection with the right foot configuration. A wearer may use a saddle 40 in connection with either or both feet and may wear a sock between saddle 40 and foot.

The thickness of saddle 40 is preferably in the range of approximately 0.035 inch to 0.015 inch, the elastic modulus ($lb/in^2$) is preferably in the range of approximately $3.5\times10^6$ to $5.0\times10^6$, and the rigidity ($lb\text{-}in^2$) is preferably in the range of approximately 12.5 to 1.5, based on a one (1) inch-wide sample. Further, member 42 may have a plurality of holes or perforations therein for weight reduction and for the cooling of the foot.

The present invention also provides a method of dissipating or dispersing pressure between footwear and the instep of a wearer's foot comprising the steps of positioning a footwear saddle 40 on the top of the foot between the wearer's metatarsal phalangeal joints and the anterior tibial tendon, the saddle 40 having a first or distal edge 52 which is canted upwards, a second or proximal edge 54 which is canted upwards and a medial edge 48 which is canted upwards. The saddle 40 may be provided with a bridge 46, wherein the positioning of saddle 40 includes the step of positioning the bridge 46 along and over the dorsal metatarsal area or instep of the wearer's foot toward the medial side of the foot.

It is to be understood that the saddle 40 is sized similar to saddle 10 and that saddles 10 and 40 are both sized to accomodate the wearer's foot so as to be positioned with respect thereto as described hereinabove. Further, saddles 10 and 40 are both preferably a unitary or single piece of stiff but resilient plastic such as Novetek thermoplastic graphite composite, made up of carbon and glass fibers with an acrylic-based resin which is used as a binder and coats the fibers, manufactured by Biomechanical Composites, a division of Medical Materials Corporation.

The saddle 10 or 40 functions as a shield to disperse the forces of the footwear laces or other securent apparatus and is believed to obviate tendonitis, tenosynovitis, neuritis and neuropraxia for the (1) medial and intermediate dorsal cutaneous nerves with their corresponding dorsal digital nerve branches, (2) extensor digitorum longus tendon and its sheath, (3) extensor hallucis longus tendon and its sheath, and (4) extensor digitorum brevis tendons. The saddle bridge 16 and 46 further serves as an accommodative device to prevent compression and resulting numbness, tingling, pain and muscle cramping by protecting the dorsalis pedis artery and its arcuate branch, as well as the medial terminal branch of the deep peroneal nerve. This is accomplished by the positioning of bridges 16 and 46 along and over, rather than transverse to, the dorsal metatarsal area or instep of the wearer's foot.

While the footwear saddle of the present invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A footwear saddle comprising a member having a length and a width and bridge defining a channel in an underside of said member and extending along the length of said member offset from a lengthwise central axis of said member and adapted to extend over the instep of a wearer's foot between footwear and said instep for dispersing pressure between said footwear and said wearer's foot, wherein a forward edge of said member and a rearward edge of said member are canted upward.

2. A footwear saddle as recited in claim 1, wherein a forward end of said member is curved upward.

3. A footwear saddle, as recited in claim 1, wherein said bridge is offset from said central axis at an angle in the range of approximately ten to fifteen degrees.

4. A footwear saddle, as recited in claim 1, wherein said member is generally arcuate.

5. A footwear saddle, as recited in claim 1, wherein said member has a generally inverted V shape.

6. A footwear saddle, as recited in claim 1, wherein the forward edge of said member has a groove therein.

7. A footwear saddle, as recited in claim 1, wherein said saddle includes a forward end bendable along a bend line and an end opposite said forward end having an arcuate edge.

8. A footwear saddle, as recited in claim 7, wherein said forward end is bendable upward at an angle of approximately two degrees.

9. A footwear saddle, as recited in claim 1, wherein said member is generally flat.

10. A footwear saddle, as recited in claim 1, wherein said member is generally rigid.

11. A footwear saddle, as recited in claim 1, wherein said member comprises a left edge having a cutout therein and a fight edge having a cutout therein.

12. A footwear saddle as recited in claim 1, wherein said member is expandable during use from a relaxed configuration to a compressed configuration.

13. A footwear saddle comprising a member having a curved forward edge, a curved rearward edge, and a bridge defining a channel in an underside of said member and extending along said member between said forward edge and said rearward edge, said bridge offset from a central axis of said member at an angle in the range of approximately ten to fifteen degrees, wherein said forward edge of said member, and said rearward edge of said member are canted upwards, said member being adapted to be placed on a wearer's foot with said bridge extending over the instep of said wearer's foot between footwear and said wearer's foot for dispersing pressure between said footwear and said wearer's foot.

14. A footwear saddle as recited in claim 13, wherein said member has a groove in said forward edge.

15. A method for dispersing pressure between footwear and a wearer's foot, comprising the steps of positioning a footwear saddle between footwear and said wearer's foot, wherein said saddle has a length and a width and includes a bridge defining a channel extending along the length of said saddle in an underside of said saddle and offset from a central lengthwise axis of said saddle and said method further comprises the step of positioning said bridge to extend along the dorsal metatarsal area of said wearer's foot to disperse pressure onto said wearer's foot, said bridge compressing to disperse pressure between said footwear and said wearer's foot.

* * * * *